US007654255B2

(12) United States Patent
Spicer

(10) Patent No.: US 7,654,255 B2
(45) Date of Patent: Feb. 2, 2010

(54) SELF-REGULATION PAINTBALL AGITATOR SYSTEM

(75) Inventor: Louis Spicer, Sewell, NJ (US)

(73) Assignee: Kee Action Sports I LLC, Sewell, NJ (US)

( * ) Notice: Subject to any disclaimer, the term of this patent is extended or adjusted under 35 U.S.C. 154(b) by 93 days.

(21) Appl. No.: 11/544,443

(22) Filed: Oct. 6, 2006

(65) Prior Publication Data

US 2007/0113834 A1 May 24, 2007

Related U.S. Application Data

(60) Provisional application No. 60/724,081, filed on Oct. 6, 2005.

(51) Int. Cl.
*F41B 11/02* (2006.01)

(52) U.S. Cl. ..... 124/51.1; 124/49

(58) Field of Classification Search ..... 124/48, 124/49, 51.1; 416/31, 43
See application file for complete search history.

(56) References Cited

U.S. PATENT DOCUMENTS

| | | | | |
|---|---|---|---|---|
| 1,404,689 | A | 1/1922 | Fairweather | |
| 1,743,576 | A | 1/1930 | Bigham | |
| 3,844,267 | A | 10/1974 | Mohr | |
| 3,855,988 | A | 12/1974 | Sweeton | |
| 3,867,921 | A | 2/1975 | Politzer | |
| 4,027,646 | A | 6/1977 | Sweeton | |
| 4,207,857 | A | 6/1980 | Balka, Jr. | |
| 4,332,097 | A | 6/1982 | Yatlor, Jr. | |
| 4,759,435 | A | 7/1988 | Cedrone | |
| 5,097,985 | A | 3/1992 | Jones | |
| 5,282,454 | A | 2/1994 | Bell et al. | |
| 5,490,493 | A | 2/1996 | Salansky | |
| 5,505,188 | A | 4/1996 | Williams | |
| 5,520,171 | A | 5/1996 | David | |
| 5,722,383 | A | 3/1998 | Tippmann | |
| 5,749,797 | A | 5/1998 | Sunseri et al. | |
| 5,791,325 | A | 8/1998 | Anderson | |
| 5,794,606 | A | 8/1998 | Deak | |
| 5,816,232 | A | 10/1998 | Bell | |
| 5,947,100 | A | 9/1999 | Anderson | |
| 5,954,042 | A | 9/1999 | Harvey | |
| 6,109,252 | A | 8/2000 | Stevens | |
| 6,109,871 | A * | 8/2000 | Nelson et al. | 416/36 |
| 6,206,562 | B1 | 3/2001 | Eyraud et al. | |

(Continued)

FOREIGN PATENT DOCUMENTS

| | | |
|---|---|---|
| DE | 3721527 | 1/1989 |

(Continued)

*Primary Examiner*—John Ricci
(74) *Attorney, Agent, or Firm*—Volpe and Koenig, P.C.

(57) ABSTRACT

A paintball agitator for use with a paintball loader is provided. The paintball agitator includes a rotatable shaft having a drive end and a second end opposite the drive end. A base portion extends radially from the shaft adjacent the second end of the shaft. The base portion is rotatable in combination with the shaft. At least one fin is pivotally affixed to the base portion and extends radially from the shaft. The at least one fin is rotatable in combination with the base portion and the shaft. The paintball agitator further includes at least one sensor mounted to the base portion that detects movement of the at least one fin.

5 Claims, 10 Drawing Sheets

U.S. PATENT DOCUMENTS

| | | | |
|---|---|---|---|
| 6,213,110 | B1 | 4/2001 | Christopher et al. |
| 6,220,237 | B1 | 4/2001 | Johnson et al. |
| 6,305,367 | B1 | 10/2001 | Kotsiopoulos |
| 6,327,953 | B1 | 12/2001 | Andresen |
| 6,347,621 | B1 | 2/2002 | Guthrie |
| 6,792,933 | B2 | 2/2002 | Christopher et al. |
| 6,408,837 | B1 | 6/2002 | Johnson et al. |
| D459,767 | S | 7/2002 | Rushton |
| 6,415,781 | B1 | 7/2002 | Perrone |
| 6,418,919 | B1 | 7/2002 | Perrone |
| 6,701,907 | B2 | 7/2002 | Christopher et al. |
| 6,467,473 | B1 | 10/2002 | Kostiopoulos |
| 6,481,432 | B2 | 11/2002 | Rushton et al. |
| 6,502,567 | B1 | 1/2003 | Christopher et al. |
| 6,526,955 | B1 | 3/2003 | Juan |
| 6,609,511 | B2 | 8/2003 | Kotsiopoulos |
| 6,644,293 | B2 | 11/2003 | Jong |
| 6,725,852 | B1 | 4/2004 | Yokota |
| 6,889,680 | B2 | 4/2004 | Christopher et al. |
| 7,021,302 | B2 | 4/2004 | Neumaster et al. |
| 6,739,323 | B2 | 5/2004 | Tippmann, Jr. |
| 6,915,792 | B1 | 7/2005 | Sheng |
| 6,981,493 | B1 | 1/2006 | Poteracku |
| 7,017,569 | B2 | 3/2006 | Jong |
| 7,270,121 | B2 | 9/2007 | Lubben |
| 2002/0014230 | A1 | 2/2002 | Christopher |
| 2002/0020402 | A1 | 2/2002 | Kotsiopoulos |
| 2002/0117159 | A1 | 8/2002 | Kotsiopoulos |
| 2004/0074487 | A1 | 4/2004 | Christopher et al. |
| 2004/0074489 | A1 | 4/2004 | Neumaster |
| 2004/0211402 | A1 | 10/2004 | Christopher et al. |
| 2006/0086347 | A1 | 4/2006 | Hedberg |
| 2006/0249131 | A1 | 11/2006 | Broersma |
| 2007/0101981 | A1 | 5/2007 | Chen |

FOREIGN PATENT DOCUMENTS

| | | |
|---|---|---|
| DE | 4343871 | 6/1994 |
| DE | 19922589 | 12/2000 |
| EP | 01054228 | 11/2000 |
| EP | 01653189 | 5/2006 |
| GB | 2322438 | 8/1998 |
| JP | 1179898 | 7/1989 |
| WO | 98/13660 | 4/1998 |
| WO | 01/44745 | 6/2001 |

* cited by examiner

SELF-REGULATION PAINTBALL AGITATOR SYSTEM

CROSS REFERENCE TO RELATED APPLICATION

This application claims the benefit of U.S. Provisional Application No. 60/724,081, filed Oct. 6, 2005, which is incorporated herein by reference as if fully set forth.

FIELD OF INVENTION

This invention relates to the field of paintball loaders. More specifically, it relates to a self regulating agitator that operates within a paintball loader.

BACKGROUND

Popularity and developments in the paintball industry have led to the demand for increased performance from paintball guns, which are compressed gas guns, also referred to as "markers." Paintball gun users usually partake in paintball sport games. A paintball sport game is generally played between two teams of players that try to capture the opposing team's flag. Each flag is located at the team's home base. Such a game is played on a large field with opposing home bases at each end. The players are each armed with a paintball gun that shoots paintballs. Paintballs are generally gelatin-covered spherical projectiles, such as capsules filled with paint, such as a colored dye.

During the game, the players of each team advance toward the opposing team's base in an attempt to steal the opposing team's flag. The players must do so without first being eliminated from the game by being hit by a paintball shot by an opponent's marker. When a player is hit by a paintball, the gelatin capsule ruptures and the paint "marks" the player. As a result the player is out of the game.

These sport games have increased in popularity and sophistication resulting in more elaborate equipment. One such improvement is the use of semi-automatic and automatic paintball guns which allow for rapid firing of paintballs. As a result of the increased firing speed, a need has developed for increased storage capacity of paintballs in the paintball loaders that are mounted to the gun. Also, users demand faster feed rates as the guns continue to develop.

Paintball loaders (otherwise known as "hoppers" or "magazines") sit atop the markers and feed projectiles into the marker. These loaders (the terms "hopper" and "loader" are used interchangeably herein) store projectiles, and have an outlet or exit tube (outfeed tube or neck). The outlet tube is connected to an inlet tube (or feed neck) of a paintball marker, which is in communication with the breech of the paintball marker.

Many loaders contain agitators or drive feed systems to mix, propel, or otherwise move projectiles in the loader. This mixing is performed by an impeller, projection, drive cone, agitator, paddle, arm, fin, carrier, or any other mechanism, such as those shown and described in U.S. Pat. Nos. 6,213,110; 6,502,567; 5,947,100; 5,791,325; 5,954,042; 6,109,252; 6,889,680; and 6,792,933, the entire contents of which are all incorporated by reference in their entireties herein. In a "gravity feed" or "agitating" loader, an agitator mixes projectiles so that no jams occur at the exit opening of the outlet tube. In a "force feed" or "active feed" paintball loader, the agitator (drive cone, carrier, paddle, arm or any other force feed drive system) forces projectiles through the exit tube. Because it is desirable to eliminate as many opposing players as possible, paintball markers are capable of semi-automatic rapid fire. The paintball loaders act to hold a quantity of projectiles, and ensure proper feeding of the projectiles to the marker for firing. All of the various forms of impellers described are referred to collectively herein as "agitators."

During normal operation of an agitating paintball loader, paintballs dropped through a bottom outlet opening of the loader form a paintball stack within the outlet tube and gun inlet tube. When the paintball at the bottom of the stack is dropped into the firing chamber of the paintball gun, it is replaced, at the top of the stack, from the supply of paintballs remaining in the loader housing, thereby replenishing the stack. In replenishing the stack of paintballs, however, jams sometimes occur within the loader, above its bottom outlet opening. Paintball jams of this nature prevent normal gravity-fed delivery of paintballs downwardly through the bottom outlet opening, with the result that the paintball stack can be totally depleted after several shots of the paintball gun.

One solution for clearing paintball jams involves forcibly shaking the paintball gun and attached loader to dislodge the paintballs that are causing the jam within the loader. This solution is undesirable as it interrupts the proper aiming of the paintball gun and correspondingly interrupts the paintball gun user's ability to shoot the paintballs continuously and rapidly.

Many paintball loaders include an agitator housed within the loader. An agitator is typically a rotating member with paddles, fins or other types of impellers. The fins of the agitator continually agitate, jumble, or stir the paintballs within the loader, which reduces the likelihood of a loader jam as the paintballs fall under the force of gravity from the outlet tube of the loader to the inlet tube of the paintball gun for firing. When a jam does occur, however, a conventional agitator typically continues to rotate despite the jam, possibly breaking paintballs. Thus, the agitator continues to contact jammed paintballs and continues to try to move the paintballs. Such a condition typically stops the feeding of paintballs, can damage or break paintballs, and can render the agitator and/or loader inoperable.

Accordingly, there remains a need for an improved agitator that effectively operates within a paintball loader notwithstanding the potential for jammed paintballs within the loader.

SUMMARY

The present invention provides a paintball agitator for use with a paintball loader. The paintball agitator includes a rotatable shaft having a drive end and a second end opposite the drive end. A base portion extends radially from the shaft adjacent the second end of the shaft. The base portion is rotatable in combination with the shaft. At least one fin is pivotally affixed to the base portion and extends radially from the shaft. The at least one fin is rotatable in combination with the base portion and the shaft. The paintball agitator further includes at least one sensor mounted to the base portion that detects movement of the at least one fin.

The present invention further provides a paintball agitator including a rotatable shaft having a drive end, a second end opposite the drive end, and a base portion extending radially from the shaft adjacent the second end. At least one fin is pivotally affixed to the base portion, and at least one sensor is mounted to the base portion that detects movement of the at least one fin.

The present invention also provides a paintball loader including a paintball loader body adapted to receive a plurality of paintballs. An agitator is mounted within the paintball loader body. The agitator includes a rotatable shaft having a drive end and a second end opposite the drive end. A base portion extends radially from the shaft adjacent the second end, the base portion being rotatable in combination with the shaft. At least one fin is pivotally affixed to the base portion, and at least one sensor is mounted to the base portion that detects movement of the at least one fin. The paintball loader further includes a motor that rotates the shaft.

The present invention further provides a method of operating a paintball loader filled with paintballs. An agitator is provided including at least one moveable fin, and a sensor is provided that detects movement of the at least one fin. A signal is transmitted in response to movement of the at least one fin, and operation of the agitator is controlled in response to the signal.

BRIEF DESCRIPTION OF THE DRAWING(S)

DETAILED DESCRIPTION OF THE PREFERRED EMBODIMENT(S)

Figure 1:
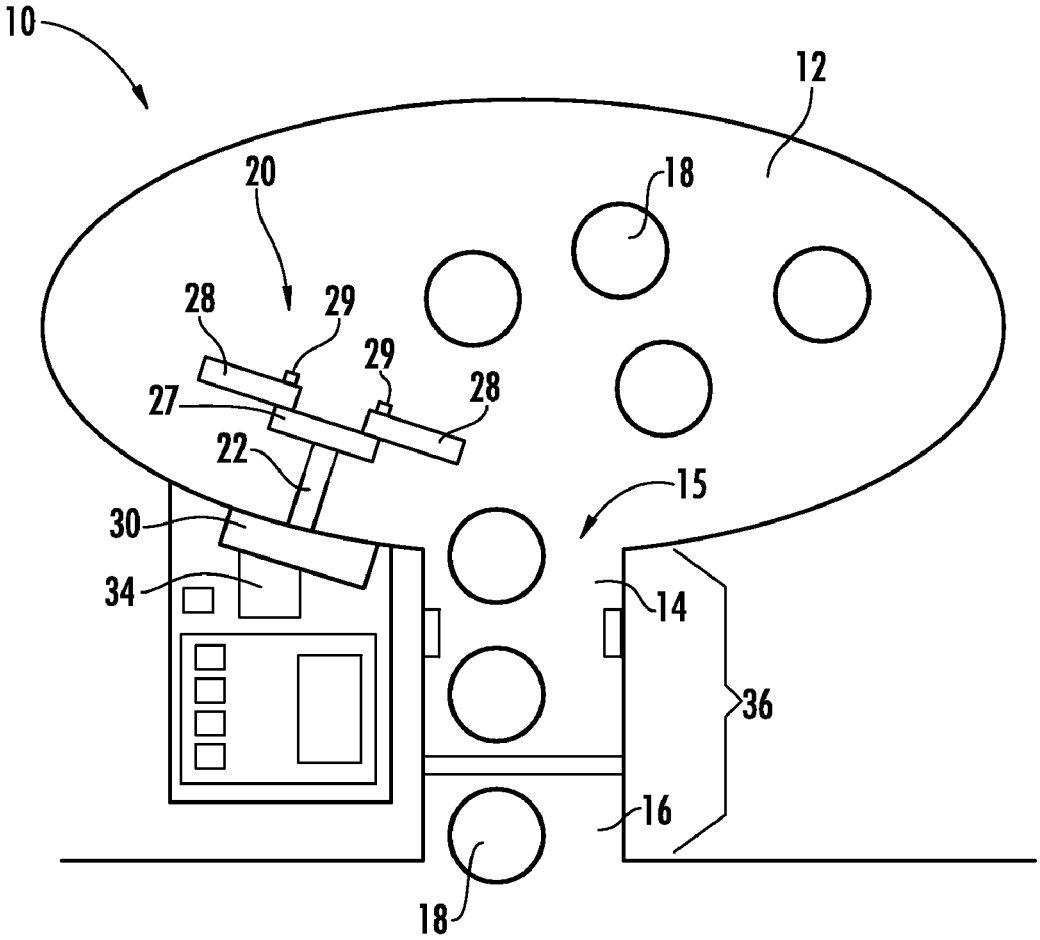
FIG. 1 is a side partial cutaway view of a gravity-feed paintball loader housing an agitator in accordance with the present invention.
Figure 2:
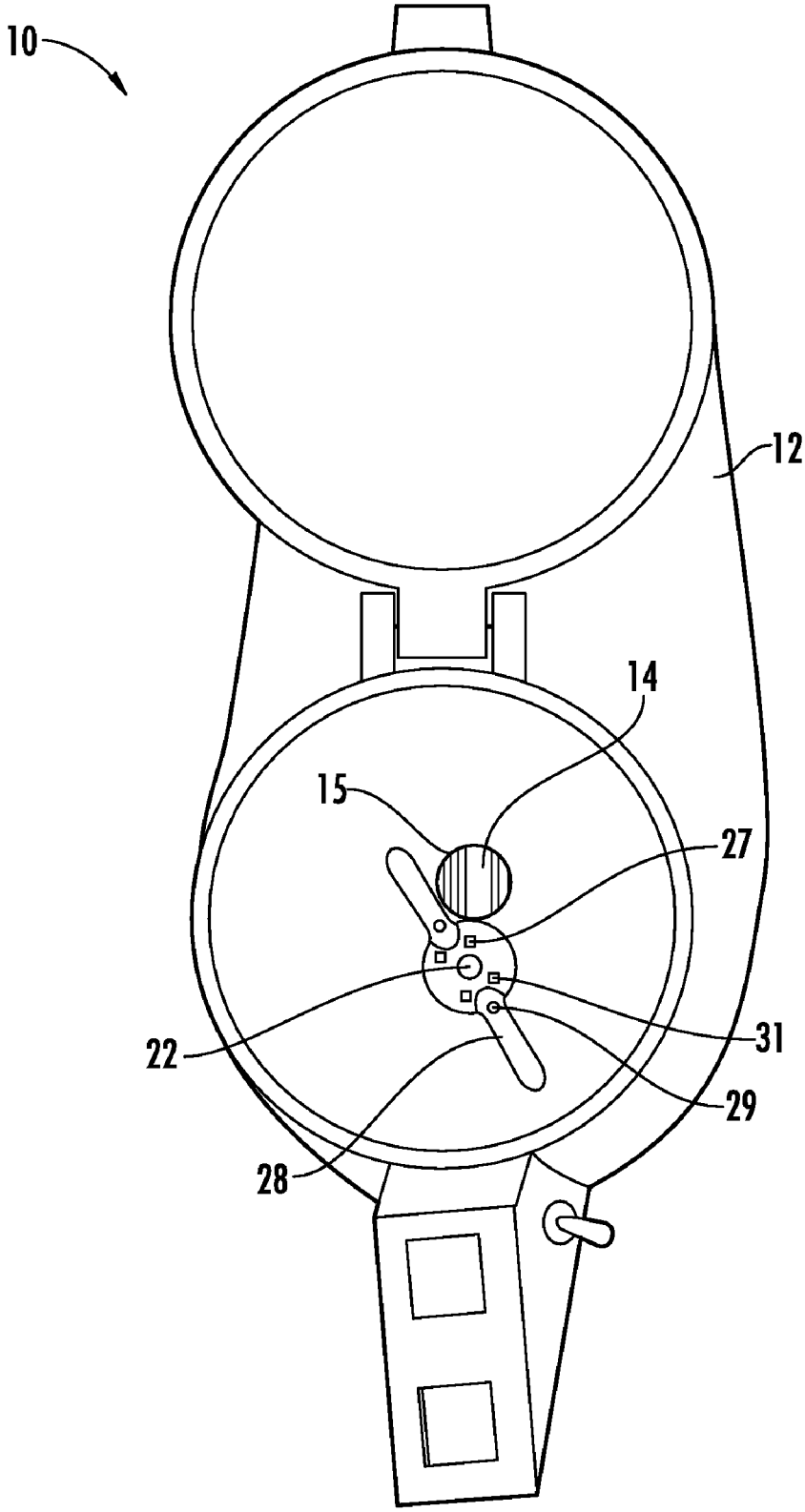
FIG. 2 is a top perspective view of the loader of FIG. 1.
Figure 3:
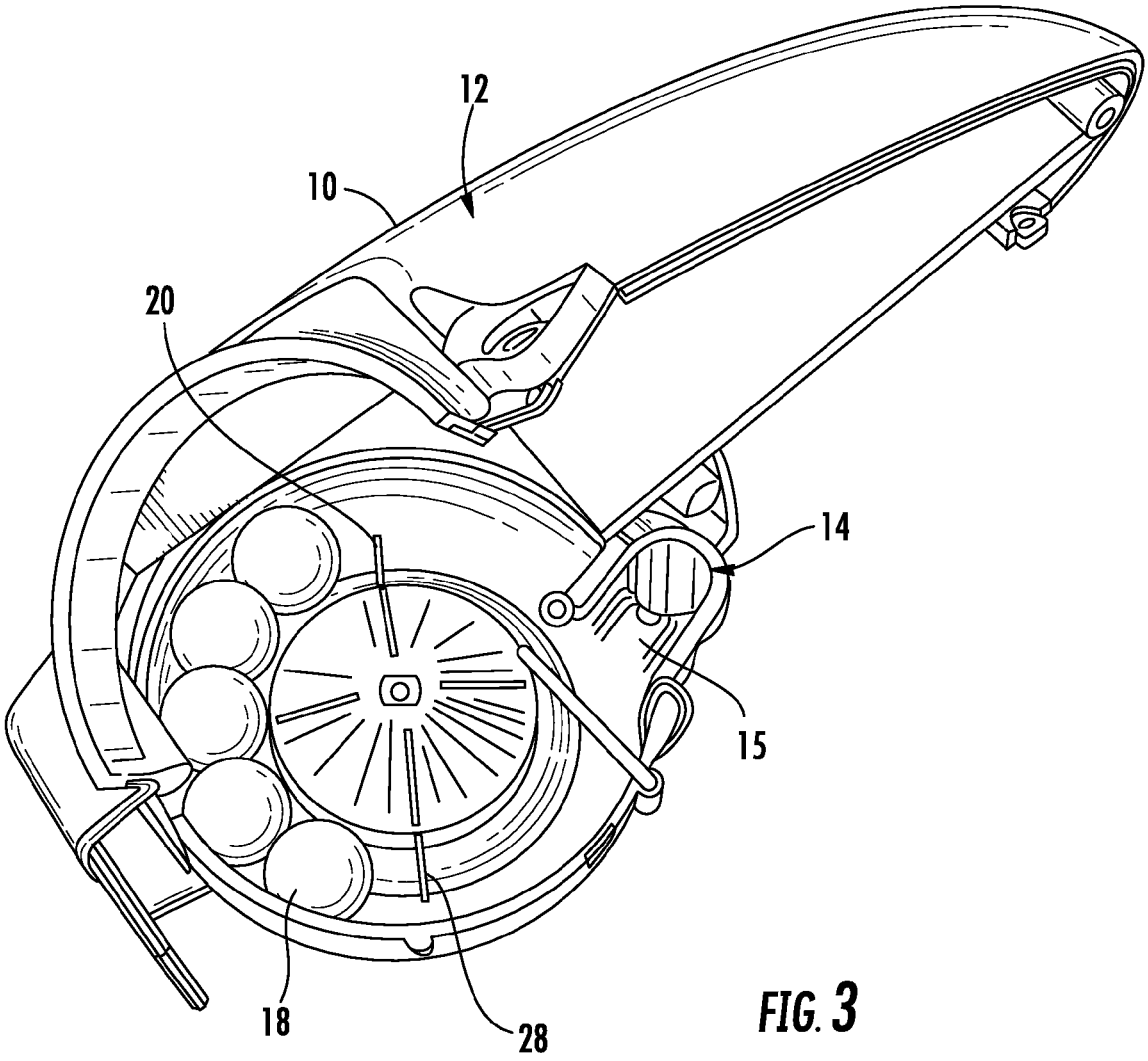
FIG. 3 is a top perspective view of an active-feed paintball loader housing an agitator in accordance with the present invention.

Certain terminology is used in the following description for convenience only and is not considered limiting. Words such as "front," "back," "top," and "bottom" designate directions in the drawings to which reference is made. Similarly, the terms "right," "left," "top," "bottom," "forward," and "rearward" are from the perspective of a user operating a compressed gas gun. Rear or rearward means toward the user and forward means away from the user. This terminology includes the words specifically noted above, derivatives thereof, and words of similar import. Additionally, the terms "a" and "one" are defined as including one or more of the referenced item unless specifically noted. The phrase "at least one of" followed by a list of two or more items, such as A, B, or C, means any individual one of A, B, or C, as well as any combination thereof. The preferred embodiments of the present invention are described below with reference to the drawing figures where like numerals represent like elements throughout.

As used herein, the terms "agitator," "feeder," "feed mechanism," "drive cone," "carrier," or "impeller" are used interchangeably and refer to any apparatus that impels, moves, pushes, agitates, or otherwise mixes projectiles held within a paintball loader or hopper, including, but not limited to, those shown and described in U.S. Pat. Nos. 6,213,110; 6,502,567; 5,947,100; 5,791,325; 5,954,042; 6,109,252; 6,889,680; and 6,792,933, the entire contents of which are incorporated herein by reference, and those used in commercially available paintball loaders such as the various HALO® brand paintball loader, the EMPIRE RELOADER™ paintball loaders, and substitutes or equivalents thereof. An exemplary paintball loader 10 is shown in more detail in FIG. 1. The portion or portions of the agitators that contact and mix or otherwise move paintballs are referred to interchangeably herein as fins, arms, paddles, paddle arms, or spokes.

Figure 7:
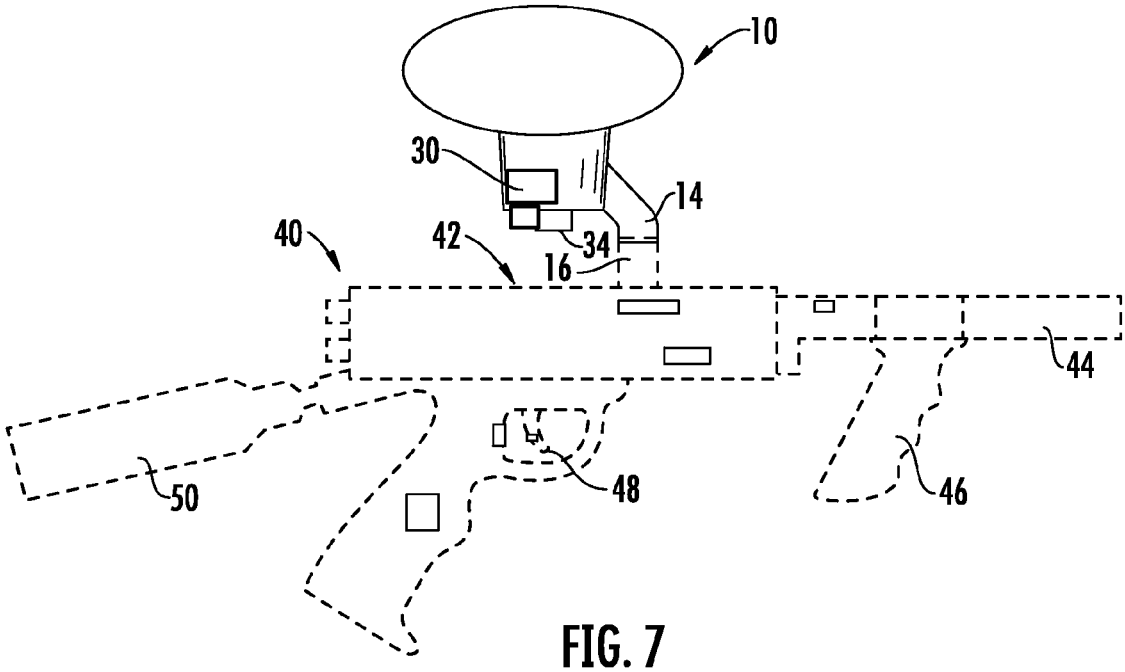
FIG. 7 is a side view showing a paintball loader mounted on an exemplary paintball marker.

FIG. 7 is a side elevational view of an illustrative paintball loader 10 according to the present invention attached to a representative paintball gun 40 illustrated in phantom. The paintball gun 40 includes a main body 42, a barrel 44, and a grip portion 46. The paintball gun 40 also includes an inlet tube 16 (also called a feed neck or infeed tube) leading to a firing chamber (or breech, not shown) in the interior of the main body 42, and a trigger 48. A source of compressed gas such as a compressed gas cylinder (gas tank) 50 is typically secured to a rear portion of the paintball marker gun 40. The compressed gas cylinder 50 normally contains $CO_2$ or $NO_2$, although any gas under pressure may be suitable.

Referring to FIGS. 1-6, generally, an embodiment of a paintball agitator 20 according to the present invention housed within a loader 10 is shown. The loader 10 includes a loader body 12 defining a space for storing paintballs 18, and an outlet tube 14 also referred to an as "outfeed tube." An exit opening 15 is provided in the loader body 12 providing communication with the outlet tube 14. In use, the outlet tube 14 is in communication with the inlet tube 16 of the paintball marker 40 as shown in FIG. 7. Paintballs 18 contained within the loader 10 move under the force of gravity through the outlet tube 14, then the inlet tube 16, and into the breech (not shown) in the interior of the main body 42 the paintball gun 40.

The agitator 20 includes a rotatable shaft 22 having a drive end 24 and a second end 26. A base portion 27 extends radially from the shaft adjacent the second end 26 of the shaft. At least one fin 28 (arm, paddle, etc.) is pivotally affixed at pivot point 29 to the base portion 27 and extends radially from the shaft 22. Any number of fins, arms, paddles or the like may extend from the shaft 22. A motor 30 (shown in FIGS. 1, 2, 7, 8, and 9) is preferably coupled to the drive end 24 of the shaft 22, wherein the shaft 22 is rotated in a clockwise or counterclockwise direction about a central axis upon actuation of the motor 30. Such motors are well known in the art of paintball loaders. The shaft 22 may be driven by a drive train, a clutch system, a spring or wind-up system, a manual crank, or any other system suitable for driving or turning the shaft 22 and resulting in rotation of the at least one fin 28.

The pivot point 29 may comprise a pivot pin, a hinge, a spring (causing the at least one fin 28 to be spring-loaded), or any other device that achieves the desired pivoting action of the at least one fin 28 relative to the base portion 27. Similarly, the at least one fin 28 may be a spring itself. The at least one fin 28 may be substantially rigid, substantially flexible, substantially elastic, or a combination thereof.

Figure 4A:
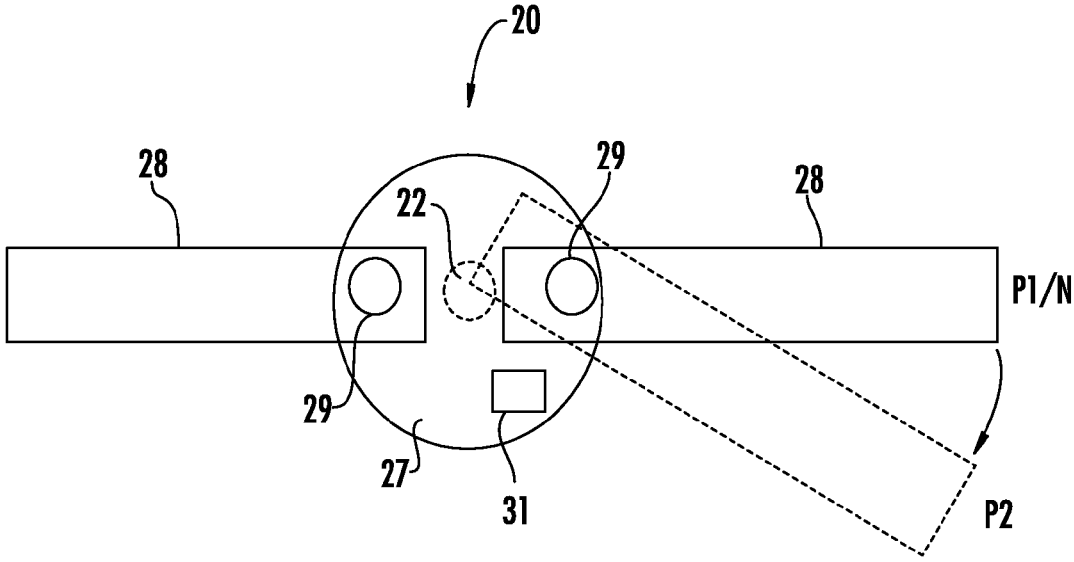
FIG. 4A is a top view of the agitator of FIG. 1, representing two fins.

The rotation of the shaft 22 as it pertains to the description of FIG. 4A is in a clockwise direction as viewed in FIG. 4A (although the shaft may rotate in either direction and may be reversible). When the fin 28 contacts, for example, a jammed or stationary paintball 18, and the force of the motor 30 on the drive shaft 22 is insufficient to un-jam the paintball 18, the force applied against the direction of rotation will cause the at least one fin 28 to pivot against its bias from a first position P1 or neutral position N (represented in FIG. 4A), to a second pivoted position designated as P2. When the jam or obstruction is otherwise removed, the at least one fin 28 is configured to spring back to the first position P1, or neutral position N.

In a preferred embodiment, the at least one fin 28 is configured for rotational movement in combination with the base portion 27 and the shaft 22 upon unimpeded rotation of the shaft 22. The at least one fin 28 is further adapted for pivotal movement with respect to the base portion 27 upon contact with an obstruction within the loader 10 (typically a jammed paintball 18), thereby permitting continuous rotation of the shaft 22 and agitation of paintballs 18 contained within the loader 10.

As explained above in the Background of Invention section, conventional agitators continue to rotate the fins against jammed, immovable paintballs, which can damage the paintballs or the agitator. The pivotal feature of the at least one fin 28 of the present invention permits the fin(s) to rotate in response to the resistive force of the stationary (jammed) paintball 18 on the fin 28, as illustrated in phantom in FIG. 3A. In this manner, breakage of the paintballs 18 or the agitator 20 is prevented.

Figure 4B:
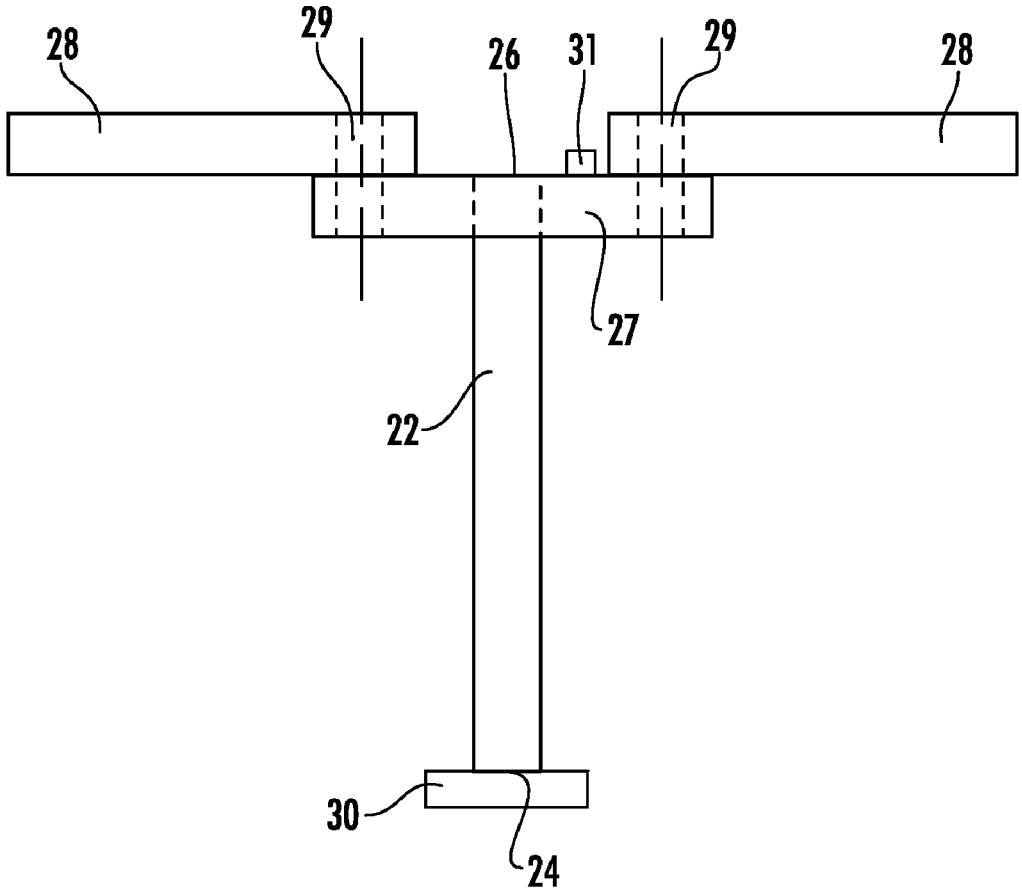
FIG. 4B is a side view of the agitator of FIG. 4A.

At least one sensor is mounted on or adjacent the base portion 27 or shaft 22 for detecting pivotal movement of the at least one fin 28 and providing self-regulation of the anti-jam features of the present paintball agitating system. As shown in FIGS. 4A and 4B, a sensor 31 is provided for detecting the position of a fin 28 relative to the base portion 27 or shaft 22 of the paintball agitator 20, that is, whether the fin 28 is in the first position P1, or in a second position such as P2.

Figure 5:
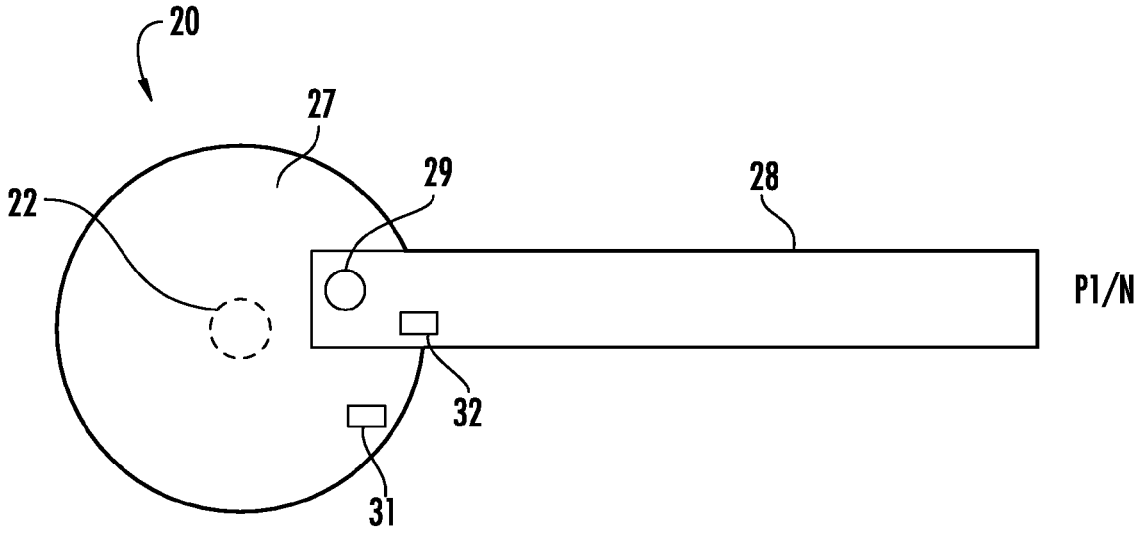
FIG. 5 is a top view of another embodiment of the agitator representing one fin in accordance with the present invention.
Figure 6:
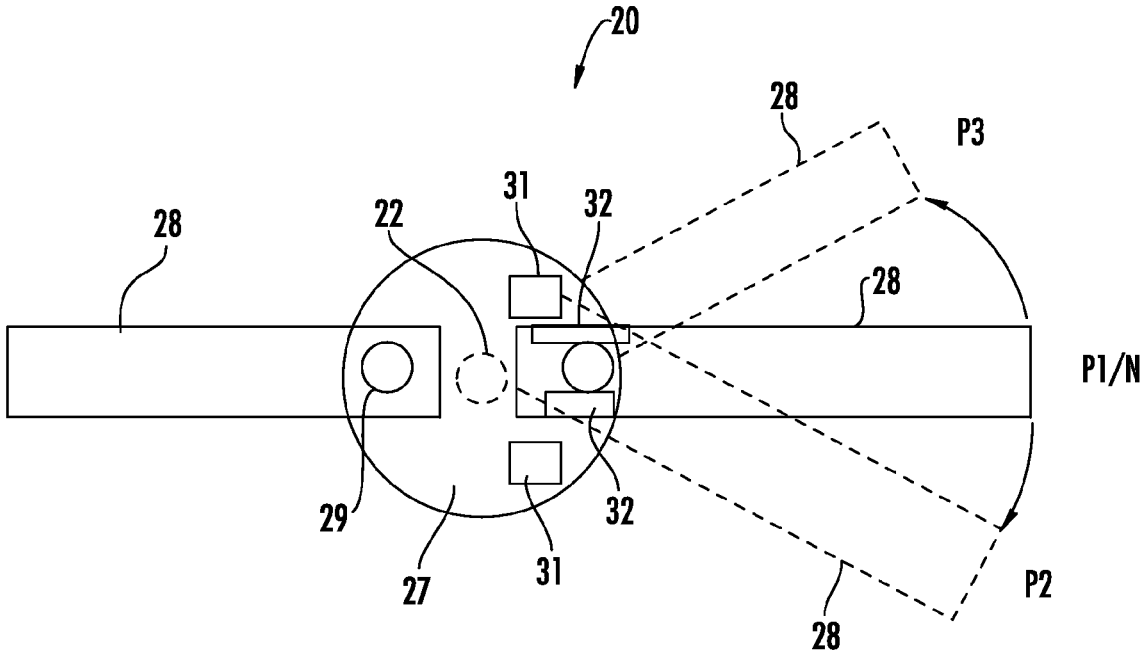
FIG. 6 is a top view of yet another embodiment of the agitator representing two fins in accordance with the present invention.

As represented in FIG. 5 (representing one fin 28) and FIG. 6 (representing two fins 28), a sensor 31 may be mounted adjacent the fin 28 on the base portion 27 and/or a sensor 32 may be mounted on the fin 28 itself, for detecting the position of the fin 28 relative to the base portion 27 of the paintball agitator 22. The sensor(s) 31, 32 may be a mechanical switch, a positional or optical sensor, a potentiometer, an accelerometer, an IR sensor, or any emitter and receiver combination for detecting the position of the fin(s) 28.

The sensor 31 and/or combination of sensors 31,32 detects when the fin(s) 28 is bent or pivoted toward a second position P2 (as represented in FIGS. 4A and 6) or a third position P3 (as represented in FIG. 6). Movement of the fin 28 toward the second position P2 results from the force applied against a clockwise direction of rotation (due to a jammed or stationary paintball 18) causing the fin 28 to pivot against its bias from the first position P1 or neutral position N. Conversely, movement of the fin 28 toward the third position P3 results from the force applied against a counter-clockwise direction of rotation (due to a jammed or stationary paintball 18) causing the fin 28 to pivot against its bias from the first position P1 or neutral position N.

Figure 8:
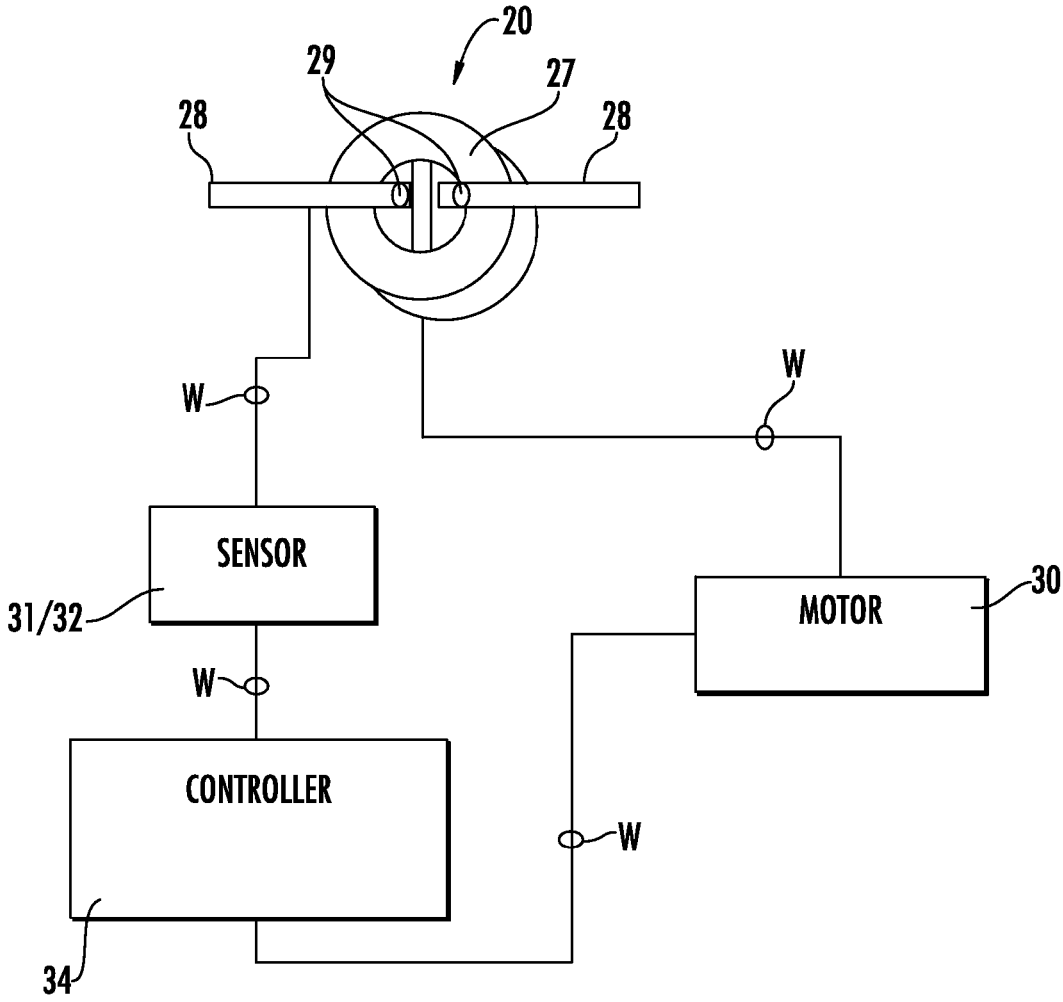
FIG. 8 is a schematic diagram showing a sensor for detecting movement of an agitator and a controller for controlling an operation of the agitator according to the present invention.

As represented in FIG. 8, when a sensor 31 or combination of sensors 31, 32 detects that a fin 28 is in the second position P2 (i.e., pivoted against its bias from the first position P1 by a jammed or stationary paintball 18), a signal is transmitted to a controller 34. The transmission may be through wires W (represented schematically in FIG. 8), or alternatively, through a wireless system. For example, a transmitter and receiver may be in communication with the sensor 31, 32 to transmit a jammed condition detected by the sensor 31, 32 to the controller 34.

The controller 34 may include any type of controller, such as a digital or analog circuit that is capable of controlling the motor 30. The controller 34 may also include circuit boards, computer "chips" and/or microprocessors, and any electric and/or electronic circuitry necessary for controlling, processing, operating, monitoring, transmitting, storing, receiving, etc., the various signals received from the sensor(s) 31, 32 and described herein or the information transmitted by such signals, as will be familiar to those in the art.

When the controller 34 receives an indication from a sensor 31, 32 that a fin 28 is bent against its bias or moved toward a second P2 or third P3 position, the controller 34 will act to operate the motor 30 of the paintball loader 10, as described in greater detail below. In the case of a wireless system, antennas (not shown) are utilized to transmit signals between the sensor(s) 31, 32 and the controller 34.

The fin(s) 28 may be spring-loaded such that the fin 28 is biased to a first P1 or neutral N position from both sides. Thus, the fin 28 can be pivoted to either a second P2 or third P3 position, as represented in FIG. 6, and will spring back to the first P1 or neutral N position. In this manner, the present invention will operate uniformly when the drive shaft 22 is rotated in either direction (clockwise or counterclockwise). The fin 28 may be spring mounted, so that it returns to a neutral N or first P1 position when it does not contact a paintball jam.

Figure 9:
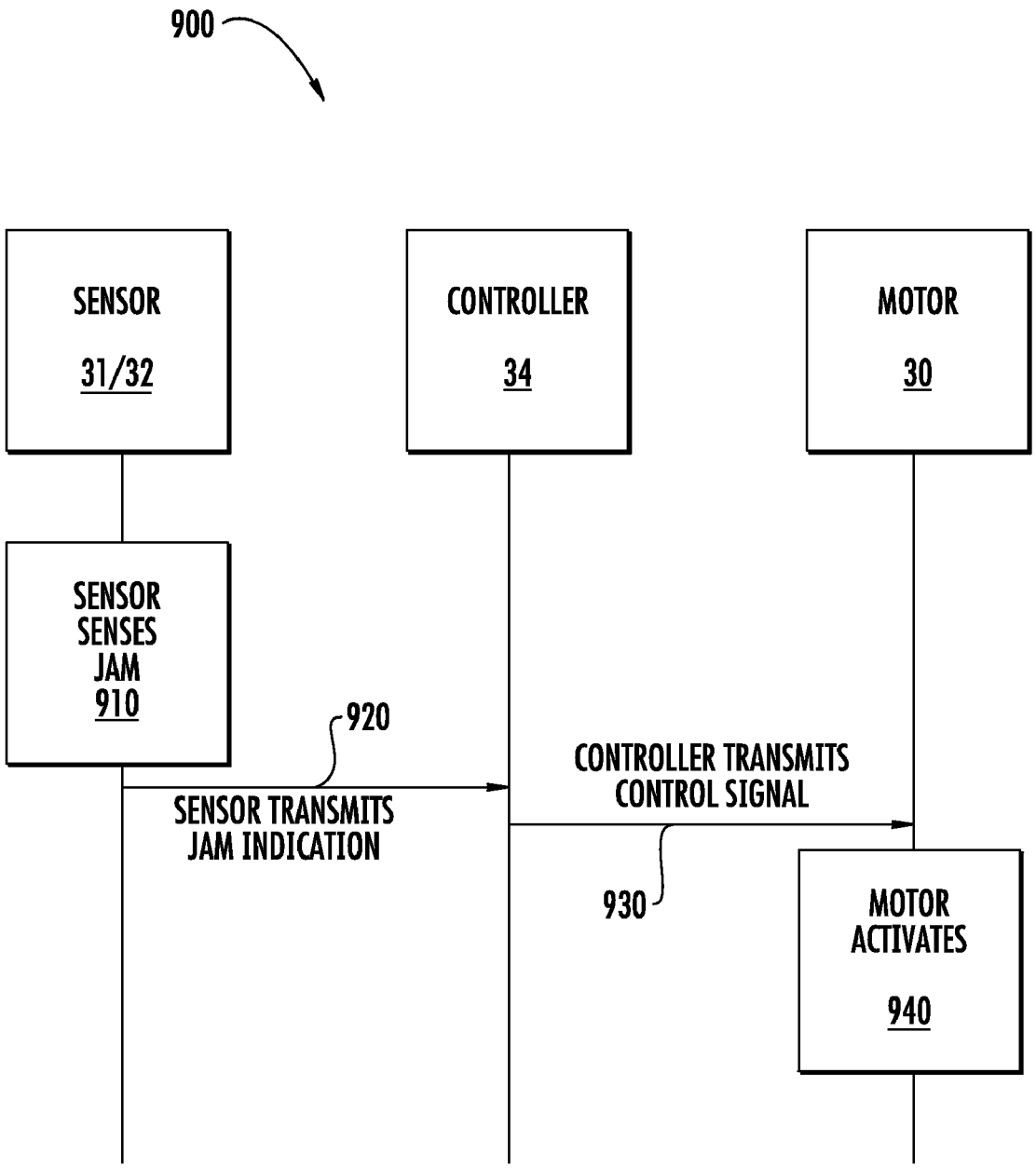
FIG. 9 is a signal diagram depicting various signal flows.

FIG. 9 is a signal diagram 900 depicting various signal flows. When a signal is received by the controller 34 indicating that a sensor(s) 31, 32 detects that a fin 28 is in the second P2 or third P3 position (i.e., when the sensor 31, 32 senses a jam 910), the sensor 31, 32 transmits a jam indication 920 to the controller 34. The controller 34 then transmits a control signal 930 to the motor 30, and the motor may be activated 940 in a variety of ways. The controller 34 may be configured to, for example, shut off the motor 30 to prevent a jammed paintball from breaking. Alternatively, the controller 34 may be configured to reverse the rotation of the motor 30 (and hence the drive shaft 22) in an opposite direction. The controller 34 may also be configured to enter a sequence in which the motor 30 is turned on and off in an attempt to clear the jam. Similarly, the controller 34 may be configured to enter a sequence in which the motor 30 rotates the drive shaft 22 first in one direction, then in the opposite direction, to agitate the paintballs 18 in the loader to clear the jam. Thus, the fin(s) 28 and sensor(s) 31, 32 combinations act to self-regulate when a paintball jam is encountered. Such features allow for continued agitation during a jam, which allows a player to more quickly clear a jam and prevent breakage. Furthermore, the present invention prevents damage to the agitator itself 20, the fin(s) 28, the drive shaft 22, the motor 30, and any associated gears, etc., because it does not attempt to rotate against an immovable force.

The system 20 of the present invention can be utilized with any existing paintball loader, such as those offered under the brands HALO®, RELOADER™, or other paintball loaders having similar designs. It is appreciated that the controller 34 may be programmed for various operations designed to take advantage of the system of the present invention.

In operation, when the motor 30 is activated, the drive shaft 22 rotates, moving the paintball agitator 20 and fin(s) 28. If paintballs 18 are free to be moved about the housing 12, the fins 28 will agitate or otherwise move the paintballs 18. The paintballs 18 may, however, begin to stack up, become jammed, or otherwise cease moving. For example, in a gravity-feed system (represented in FIGS. 1 and 2), paintballs 18 may jam at the exit opening 15 of the loader 10. In this scenario, the fin 28 will pivot against its bias when the fin 28 encounters a non-moving or jammed paintball 18. The controller 34 will receive an indication from the sensor 31 or sensors 31, 32 that the fin 28 has contacted a jammed paintball 18. The controller 34 will operate to control which direction the motor 30 turns to operate the drive shaft 22. In that manner, the agitator 20 will not rupture the paintball 18 and the jam can be cleared.

In an active feed loader (represented in FIG. 3), the paintballs 18 are forced by the agitator 20 to the exit opening 15 and the motor 30 rotates the drive shaft 22 to feed paintballs 18 to the paintball marker 40. When the paintball marker is not firing, the paintball stack 36 (shown in FIG. 1) in the outfeed tube 16 is stationary. Due to the pivoting feature of the fin(s) 28, the agitator 20 continues to rotate and the fin(s) 28 pivot away from the paintball stack 36, thereby preventing a breakage. In addition, the spring action of the fin 28 will store energy for propelling the paintballs 18 from the loader 10 once the motor 22 continues to operate in a particular direction. Thus, tension is maintained on the paintball stack 36 during operation.

The controller 34 of the present invention may be designed so that the sensors 31, 32 will only detect and send a signal in response to the fin 28 being moved a particular distance. In normal use, the fin 28 may pivot to a certain degree, even where there is no paintball jam. Thus, the sensor(s) 31, 32 and/or controller 34 may be designed so that a "jam signal" or "control signal" is generated only when the fin 28 pivots a certain distance relative to the base portion 27, or to a certain degree.

Substantially rigid fins 28 are preferably made from a rigid material such as a plastic, for example, polyurethane, nylon, or acrylonitrile butadiene styrene. The present invention, however, is not limited to such material, and the fins 28 may be made from various plastics, resin, composite, rubber, bamboo, metal, or any other material suitable for performing the above-stated functions. Rigid fins 28 of the agitator 20 of the present invention should be formed so that they will not bend when they encounter a jammed or immovable paintball 18. Rather, the force transmitted to the pivot point 29 through the rigid fin 28 will permit a rigid fin 28 to pivot in relation to the jammed or immovable paintball 18.

Substantially flexible fins 28 are preferably made from flexible and resilient polymeric material, for example, polyurethane, nylon, or acrylonitrile butadiene styrene. The present invention, however, is not limited to such material, and flexible fins 28 may be made from various plastics, resin, composite, rubber, silicone rubber, NEOPRENE®, metal, or any other material suitable for performing the above-stated functions. Alternately, as explained above, the fins 28 may comprise both rigid and flexible portions.

While the preferred embodiments of the invention have been described in detail above, the invention is not limited to the specific embodiments described which should be considered as merely exemplary. Further modifications and extensions of the present invention may be developed and all such modifications are deemed to be within the scope of the present invention as defined by the appended claims.

What is claimed is:

1. A paintball agitator for use with a paintball loader, comprising:

a rotatable shaft comprising a drive end and a second end opposite the drive end;

a base portion adjacent the second end of the shaft, the base portion being rotatable in combination with the shaft;

at least one fin pivotally affixed to the base portion and extending radially from the shaft, the at least one fin being rotatable in combination with the base portion and the shaft; and at least one sensor configured to detect the movement of the at least one fin;

wherein the at least one fin is substantially flexible.

2. The agitator of claim 1, further comprising a hinge that pivotally affixes the at least one fin to the base portion.

3. The agitator of claim 1, wherein the at least one fin comprises a spring.

4. A paintball agitator for use with a paintball loader, comprising:

a rotatable shaft comprising a drive end, a second end opposite the drive end, and a base portion adjacent the second end;

at least one fin pivotally affixed to the base portion; and at least one sensor configured to detect movement of the at least one fin, wherein the at least one fin is flexible.

5. A paintball loader comprising:

a paintball loader body that receives a plurality of paintballs;

an agitator mounted within the paintball loader body, the agitator comprising a rotatable shaft comprising a drive end and a second end opposite the drive end, a base portion adjacent the second end, the base portion rotatable in combination with the shaft, at least one fin pivotally affixed to the base portion, and at least one sensor configured to detect movement of the at least one fin; and a motor that rotates the shaft, wherein the at least one fin is flexible.

* * * * *